US008128405B2

(12) United States Patent
Preston et al.

(10) Patent No.: US 8,128,405 B2
(45) Date of Patent: Mar. 6, 2012

(54) SYSTEM, METHOD AND APPARATUS FOR RELAYING SIMULATION DATA

(75) Inventors: Steven Gordon Preston, Winter Springs, FL (US); Thomas Hans Penner, Apopka, FL (US); Charles Thomas Penrose, Oakland, FL (US); Edward Steve Kaprocki, Debary, FL (US)

(73) Assignee: Lockheed Martin Corporation, Orlando, FL (US)

( * ) Notice: Subject to any disclaimer, the term of this patent is extended or adjusted under 35 U.S.C. 154(b) by 806 days.

(21) Appl. No.: 11/340,132

(22) Filed: Jan. 26, 2006

(65) Prior Publication Data

US 2007/0009859 A1 Jan. 11, 2007

Related U.S. Application Data

(60) Provisional application No. 60/647,243, filed on Jan. 26, 2005.

(51) Int. Cl.
*F41A 33/00* (2006.01)

(52) U.S. Cl. ..... 434/11; 434/21; 434/19; 434/22; 434/16; 42/1

(58) Field of Classification Search ..... 434/11, 434/21, 22, 19
See application file for complete search history.

(56) References Cited

U.S. PATENT DOCUMENTS

| | | | | |
|---|---|---|---|---|
| 4,948,371 | A * | 8/1990 | Hall | 434/21 |
| 6,254,394 | B1 * | 7/2001 | Draper et al. | 434/11 |
| 6,579,097 | B1 * | 6/2003 | Sampson et al. | 434/21 |
| 6,798,356 | B2 | 9/2004 | Flick | |
| 6,973,865 | B1 * | 12/2005 | Duselis et al. | 89/41.05 |
| 2002/0111201 | A1 * | 8/2002 | Lang | 463/2 |
| 2002/0142783 | A1 | 10/2002 | Yoldi et al. | |
| 2004/0096806 | A1 * | 5/2004 | Davidsson et al. | 434/11 |
| 2004/0121292 | A1 * | 6/2004 | Chung et al. | 434/11 |
| 2004/0135694 | A1 | 7/2004 | Nyfelt | |
| 2004/0146840 | A1 * | 7/2004 | Hoover et al. | 434/21 |
| 2005/0258323 | A1 * | 11/2005 | Lin | 248/278.1 |

* cited by examiner

*Primary Examiner* — Xuan M. Thai
*Assistant Examiner* — Banafsheh Hadizonooz
(74) *Attorney, Agent, or Firm* — Withrow & Terranova, PLLC

(57) ABSTRACT

An apparatus for communicating simulation data is disclosed. The apparatus includes an assembly for mounting the apparatus on an edifice. The apparatus further includes a receiver for receiving simulation data from a plurality of players within a specified area of the edifice and for receiving simulation data from a central controller. The apparatus further includes a transmitter for transmitting simulation data to the plurality of players and to the central controller, wherein simulation data is transmitted to the central controller only when a simulation event occurs. In one alternative, the apparatus further includes an infrared camera for capturing video and still images of simulation events. In another alternative, the apparatus includes an infrared radiator for producing infrared light for illuminating video and still images captured by the infrared camera.

22 Claims, 13 Drawing Sheets

SYSTEM, METHOD AND APPARATUS FOR RELAYING SIMULATION DATA

CROSS-REFERENCE TO RELATED APPLICATIONS

The present patent application claims priority to U.S. provisional patent application Ser. No. 60/647,243 filed on Jan. 26, 2005 and entitled "Security Forces Simulation Training System and Method." U.S. provisional patent application Ser. No. 60/647,243 is hereby incorporated by reference in its entirety.

INCORPORATION BY REFERENCE OF MATERIAL SUBMITTED ON A COMPACT DISC

Not Applicable.

STATEMENT REGARDING FEDERALLY SPONSORED RESEARCH OR DEVELOPMENT

Not Applicable.

FIELD OF THE INVENTION

This invention relates to relaying event data, and more particularly to logging and communicating event data during military training.

BACKGROUND OF THE INVENTION

Military organizations use a variety military training techniques to instill skills into their members. One of the most effective types of military training is realistic training, otherwise known as war games. This type of training simulates actual combat scenarios and allows the participants to undergo a realistic combat experience. War games usually involve actual deployments of troops and vehicles into a limited area and include all of the movement and action that takes place during a real combat scenario but typically without the danger of live ordinance and ammunition.

Multiple Integrated Laser Engagement System (MILES) is a military training system that provides a realistic battlefield environment for soldiers involved in training exercises. MILES provides tactical engagement simulation for direct fire force-on-force training using eye safe laser "bullets." Each individual and vehicle in the training exercise has a detection system to sense hits and perform casualty assessment. Laser transmitters are attached to each individual and vehicle weapon system and accurately replicate actual ranges and lethality of the specific weapon systems. MILES training has been proven to dramatically increase the combat readiness and fighting effectiveness of military forces.

Soldiers use MILES devices primarily during force-on-force exercises, from squad through brigade level, to simulate the firing and effects of actual weapons systems. These weapons systems include the M1 Abrams Tank, Bradley Infantry Fighting Vehicle, M113 Armored Personnel Carrier, wheeled vehicles and other non-shooting targets. Additionally, basic MILES simulations address anti-armor weapons, machine guns, rifles, and other ancillary items, such as a controller gun, within the program. Combat vehicles, support vehicles and individual solders are instrumented with a GPS receiver for position location determination and a transmitter for sending all recorded data back to central command. All player activity is recorded during an exercise. Position location, and direct and indirect fire event reporting is accomplished through the associated transmitter.

One of the restrictions on the mobile units used on individual soldiers and some vehicles is energy expenditure. These mobile units run on battery power, which is finite and sometimes too short. As such, various aspects of the system often drain battery power rather quickly. One example is the periodic nature by which a mobile unit gathers and transmits data, even if no event has transpired since the last event was gathered and transmitted. This can be redundant and wasteful of battery power. Further, event data may sometimes have to be transmitted over long distances to a command and control center. This can quickly drain a battery's resources as transmissions over longer stances require higher signal strengths. This is not an optimal use of resources.

Another problem with the mobile units used during training exercises is radio attenuation and radio frequency (RF) reflections. Various environmental factors can affect the strength, path and overall structure of a radio signal. Varied terrain such as mountains, forests and hills can reduce signal strength and sometimes block the signal completely. Likewise, man-made structures such as buildings and vehicles can attenuate a radio signal and garble the information within it. A common transmission problem arises when individuals are inside buildings or other structures. Transmissions of an RF signal inside a room or other structure can lead to reflections, reduced signal strengths and different types of interference.

Much like transmissions from inside of a building to the outside can be compromised, transmissions from outside a building to receivers inside of a building can also be compromised. Various procedures of the MILES system call for the transmission of a command or other signal to wearers of a mobile unit. When the wearer is inside of a building, this can pose an obstacle to the reception of a clear signal. Thus, it can be difficult to track individuals inside of structures as the exchange of information over radio can be blocked by walls. It can further be difficult to disseminate game information, such as simulated explosions and shots, inside of a building as the signals do not always survive travel. And further, exchanging MILES information between players inside of an edifice is not always successful.

Therefore, a need exists to overcome the problems with the prior art as discussed above, and particularly for a more efficient way for logging and communicating event data during simulation exercises conducted in or around man-made structures.

SUMMARY OF THE INVENTION

Briefly, according to an embodiment of the present invention, an apparatus for communicating simulation data is disclosed. The apparatus includes an assembly for mounting the apparatus on an edifice. The apparatus further includes a receiver for receiving simulation data from a plurality of players within a specified area of the edifice and for receiving simulation data from a central controller. The apparatus further includes a transmitter for transmitting simulation data to the plurality of players and to the central controller, wherein simulation data is transmitted to the central controller only when a simulation event occurs.

In another embodiment of the present invention, a simulation system on a computer is disclosed. The simulation system includes a central controller for storing simulation data, the central controller including a transmitter and a receiver, and at least one computer apparatus for communicating simulation data. The computer apparatus includes an assembly for mounting the computer apparatus on an edifice and a receiver for receiving simulation data over radio frequency from a plurality of players within a specified area of the edifice and for receiving simulation data from the central controller. The computer apparatus further includes a transmitter for transmitting simulation data over radio frequency to the plurality of players and to the central controller, wherein simulation data is transmitted to the central controller only when a simulation event occurs.

In another embodiment of the present invention, a method on a computer for conducting a simulation is disclosed. The method includes receiving simulation data on a computer apparatus on an edifice over radio frequency from a plurality of players within a specified area of the edifice. The method further includes receiving simulation data on the computer apparatus from a central controller. The method further includes transmitting simulation data to the central controller and to the plurality of players over radio frequency, wherein simulation data is transmitted only when a simulation event occurs.

The foregoing and other features and advantages of the present invention will be apparent from the following more particular description of the preferred embodiments of the invention, as illustrated in the accompanying drawings.

BRIEF DESCRIPTION OF THE DRAWINGS

The subject matter, which is regarded as the invention, is particularly pointed out and distinctly claimed in the claims at the conclusion of the specification. The foregoing and other features and also the advantages of the invention will be apparent from the following detailed description taken in conjunction with the accompanying drawings. Additionally, the left-most digit of a reference number identifies the drawing in which the reference number first appears.

DETAILED DESCRIPTION

The present invention provides an apparatus for communicating simulation data. The apparatus, for mounting on an edifice, includes both a receiver for receiving simulation data from players and a central controller and a transmitter for transmitting simulation data to the players and to the central controller only when a simulation event occurs. In one alternative, the apparatus further includes an infrared camera for capturing video and still images of simulation events. In another alternative, the apparatus includes an infrared radiator for producing infrared light for illuminating video and still images captured by the infrared camera.

It can be costly in terms of expended energy to have mobile simulation units send simulation data, such as location and status, periodically. If a unit's data has not changed since the last transmission, it is redundant and wasteful of battery power. It can further be costly in terms of expended energy and bandwidth to have all mobile simulation units report simulation data periodically. The features of the present invention are beneficial as they allow for the transmission of simulation data, such as crucial simulation event data, only when events occur, so as to lighten the load on bandwidth and processing power of the units.

The features of the present invention are further advantageous as they allow for player tracking within buildings and other structures, as well as the simulation of walls breaching and extending explosions patterns of a simulated round. The present invention is further beneficial as it allows for the simulation of a bomb exploding within a room of an edifice and the simulation of pop-up targets firing back. Lastly, the present invention allows for the backlighting of a room within an edifice using infrared light that does not visibly lighten the room so as to allow an infrared camera to take a still image of a room during a simulation event. This is beneficial as it preserves the realistic nature of a simulation while allowing the taking of pictorial evidence of a simulation event for educational purposes.

Figure 1:
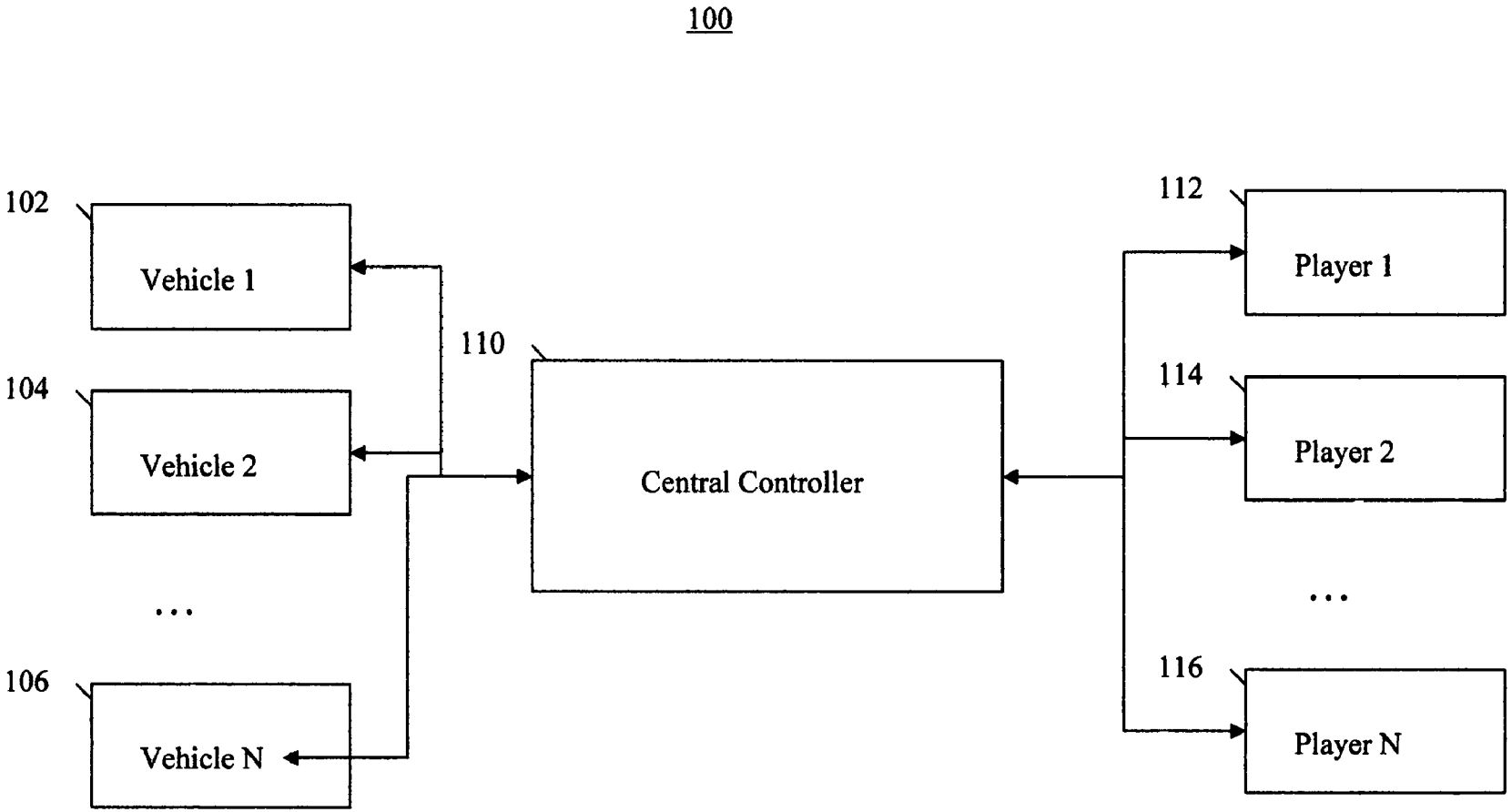
FIG. 1 is a block diagram showing the system architecture of a conventional radio-controlled military simulation system.

FIG. 1 is a block diagram showing the system architecture of a conventional radio-controlled military simulation system 100. The radio-controlled military simulation system 100 includes a plurality of vehicles 102, 104 through 106, such as tanks, jeeps, armored personnel carriers and heavy hauling equipment. The radio-controlled military simulation system 100 further includes a plurality of individuals 112, 114 through 116, representing soldiers and other individuals participating in the simulation. Each vehicle 102, 104, 106 and individual 112, 114 and 116 in the simulation system can interact with each other as well as with the central controller 110, which controls various aspects of the simulation via radio communication and records simulation information.

The central controller 110 includes a radio communication system, as well as a computer network capable of tracking multiple participating entities, controlling various aspects of game play and storing various types of information regarding the simulation. See FIG. 12 and the accompanying description for a more detailed explanation of a computer system useful for implementing the central controller 110.

As explained above, each vehicle 102, 104, 106 and individual 112, 114 and 116 can be outfitted with a mobile simulation unit that can receive and transmit signals, infrared (IR) signals and radio frequency (RF) signals, for example, such as in the MILES simulation system used by the U.S. military for realistic combat training. The central controller 110 is further able to communicate with the vehicles 102-106 and individuals 112-116 via RF and IR signals. IR signals are typically used to indicate to a mobile simulation unit that the receiver has been injured, killed or otherwise compromised. RF signals are typically used to send a message or other information among mobile simulation units and/or the central controller 110. The MILES simulation system, for example, operates a 285-350 MHz or a 2.4 GHz RF communication system with a range of 10 km over a 20 km squared area.

RF signals can be used to exchange information among mobile simulation units during a simulation. For example, during game play mobile simulation units on individuals 112, 114 and 116 can each broadcast a personal identification (PID) code to indicate the identification of the player. Vehicles 102, 104 and 106 may also broadcast PIDs. In this manner, the central controller 110 may keep up to date on the locations and status of each vehicle 102-106 and player 112-116 in the simulation. The central controller 110 may also send various types of messages to entities participating in the simulation, such as a system command that resets the simulation or a game command that orders an entity to die or become resurrected.

A mobile simulation unit can send out an IR signal when, for example, a player 112 or a vehicle 102 fires a weapon. IR signals are suitable for line-of-sight simulation and are therefore used to simulate weapons firing. The transmission of an IR signal during firing of a weapon can include the PID of the firing entity, a weapon code indicating the type of weapon used and an injury code indicating the type of injury that would be sustained by the receiving entity in such a situation.

It should be noted that although FIG. 1 shows only three vehicles 102-106 and three individuals 102-106, a conventional radio-controlled military simulation system 100 may typically support high numbers (sometimes thousands) of entities participating in the simulation.

Figure 2:
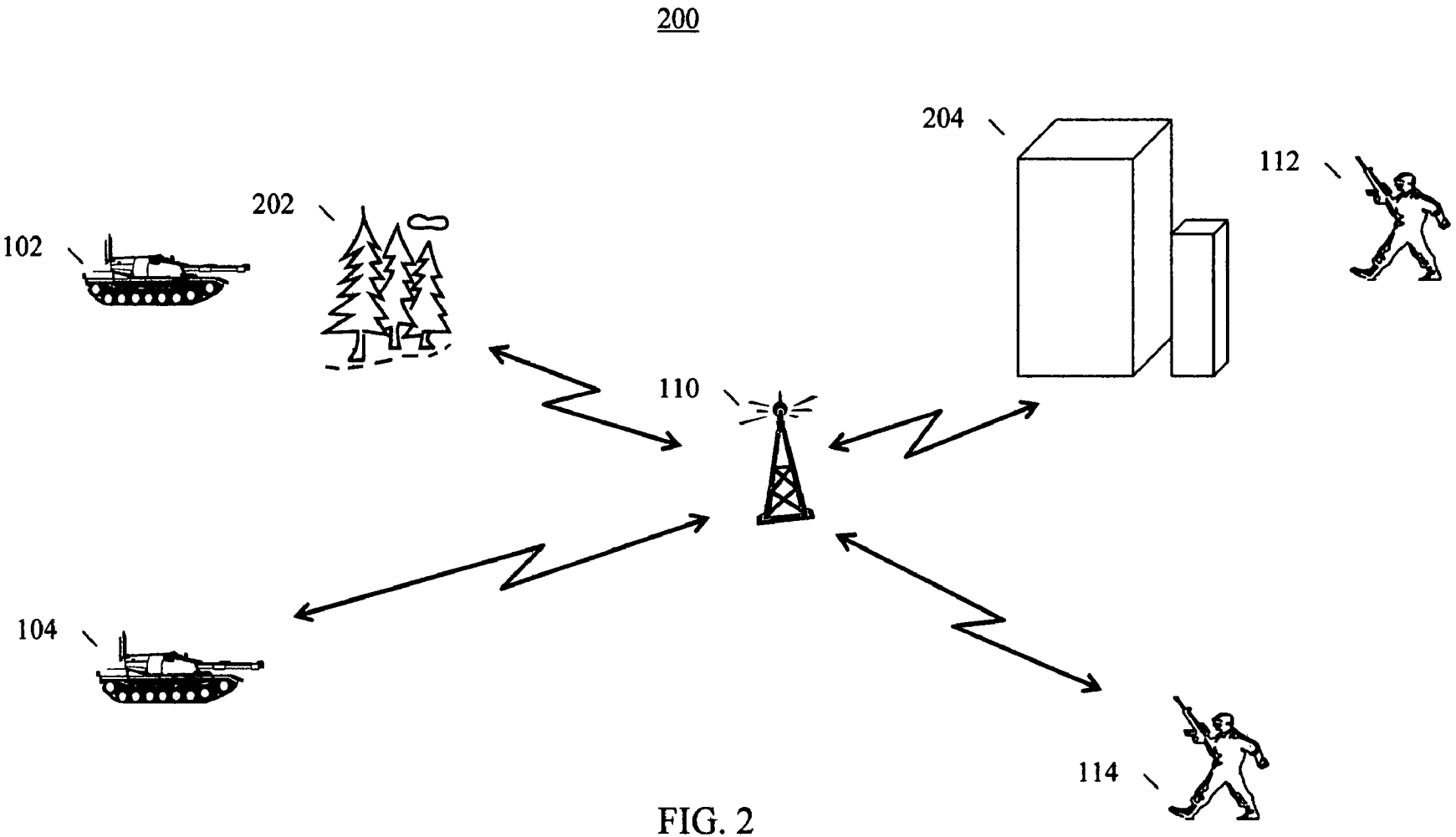
FIG. 2 is an illustration showing an outdoors implementation of the conventional radio-controlled military simulation system of FIG. 1.

FIG. 2 is an illustration showing an outdoors implementation 200 of the conventional radio-controlled military simulation system 100 of FIG. 1. The radio-controlled military simulation system 200 includes the vehicles 102, 104 (tanks in this example) and individuals 112, 114 (soldiers on foot) participating in the simulation. FIG. 2 further shows the central controller 110, which controls various aspects of the simulation via radio communications.

As explained above, one problem with the mobile units used during training exercises is radio attenuation and RF reflections. Various environmental factors can affect the strength, path and overall structure of a radio signal. Varied terrain and man-made structures can attenuate a radio signal and garble the information within it. Further, transmissions from outside a building to receivers inside of a building can also be compromised.

FIG. 2 shows that although vehicle 104 is able to receive unimpeded RF communications from the central controller 110, vehicle 102 appears to be receiving garbled or attenuated RF signals from the central controller 110 due to environmental obstacles—namely, a forest 202 or other vegetation. FIG. 2 further shows that although individual 114 is able to receive unimpeded RF communications from the central controller 110 on his mobile simulation unit, individual 112 appears to be receiving distorted or blocked RF signals from the central controller 110 due to man-made obstacles—namely, buildings 204. RF and IR signals can be even more difficult to propagate to individuals and soldiers located within buildings.

Figure 3A:
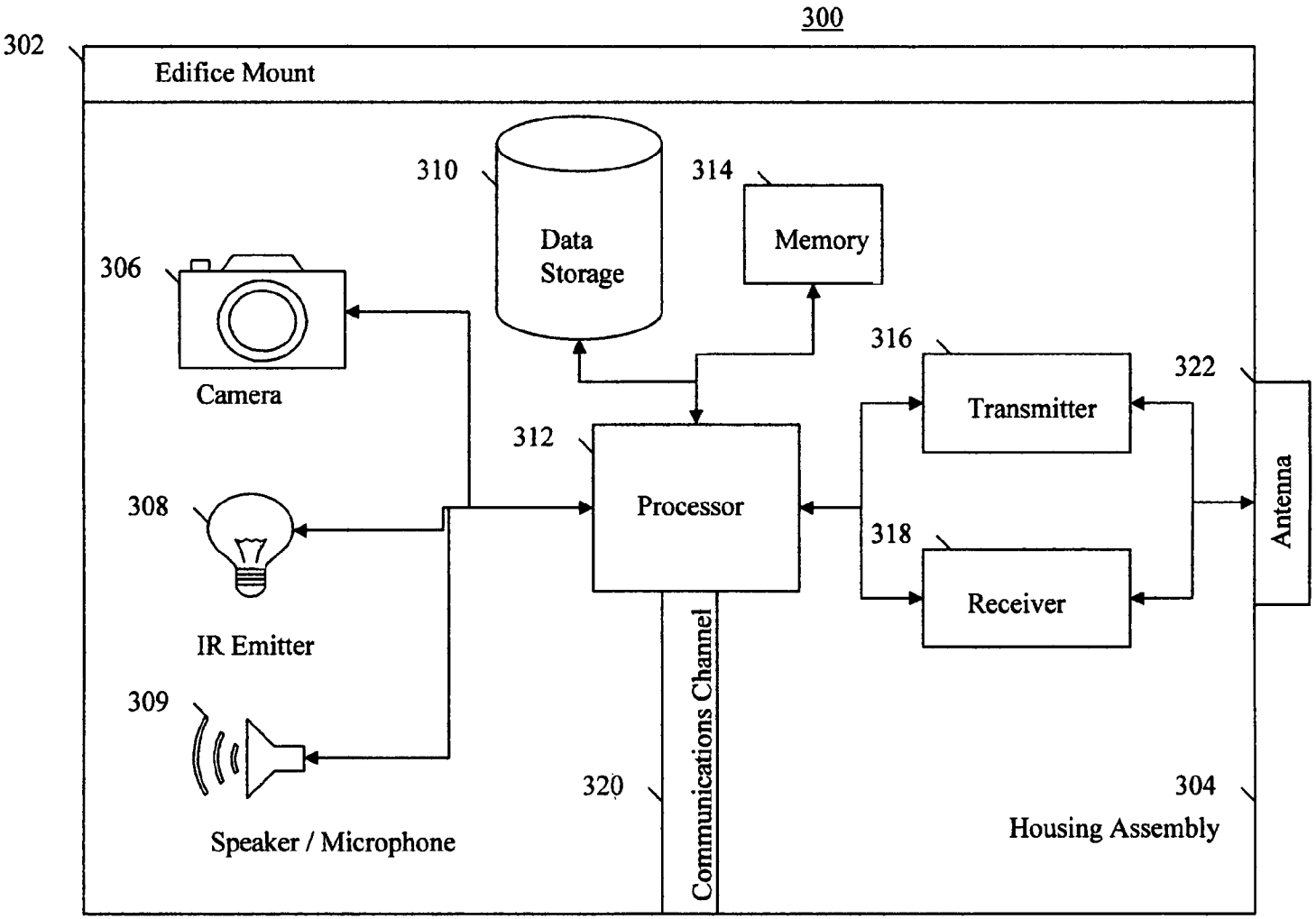
FIG. 3A is a block diagram showing the apparatus in one embodiment of the present invention.

FIG. 3A is a block diagram showing the apparatus 300 in one embodiment of the present invention. FIG. 3A shows the room associator 300 of the present invention, used for relaying signals and other simulation data within or around edifices during the course of a simulation. The room associator 300 is encased in a housing assembly 304 that may be constructed of plastic, a light metal such as aluminum, titanium, metal alloys, composite materials or any other material suitable for housing an electronic computing and radio system. The room associator 300 further includes an edifice mount 302 that is used to mount the room associator 300 onto a wall, a ceiling, a floor, a corner or any other fixture or portion of a room, an exterior element or interior element of an edifice. The edifice mount 302 may be coupled to a portion of an edifice using a fastener such as a screw, a bolt, a nail or the like.

FIG. 3A further shows that the room associator 300 includes a central processor 312 that can be any well known commercial microprocessor such as the AMD Athlon 64 3000, the IBM PowerPC 970 or the Intel Pentium D 820. Connected to the central processor 312, the room associator 300 also includes data storage 310, which may be any non-volatile data storage device, such as a hard drive, and a memory 314, which may be any volatile memory device, such as a random access memory (RAM) element. The data storage 310 and memory 314 are used to store data regarding messages that are exchanged during the simulation, images or video that is taken by camera 306 and sounds that are recorded or emitted by speaker/microphone 309.

The room associator 300 further includes a camera 306, which may be any commercially available charged coupling device (CCD) or other type of image capture device for taking still or video images. Also coupled to the central processor 312, the camera 306 may be configured to capture images illuminated by visible light or configured to capture images illuminated by IR light during certain simulation events.

Also connected to the central processor 312 is an IR emitter 308 and a speaker/microphone 309. The IR transmitter 308 can be used to send informational IR signals during the simulation, as described above, and may also be used to backlight or illuminate a scene with IR light in order for the camera 306 to adequately capture an image. The speaker/microphone 309 is utilized to emit sounds of varying types, such as sound cues used during a military simulation, including sounds of explosions and shots. The speaker/microphone 309 is further utilized to record sounds during certain simulation events for storage.

Also connected to central processor 312 is a transmitter 316 and a receiver 318. The transmitter 316 is utilized to transmit RF signals via the antenna 322 during a simulation, as described more fully above with reference to FIG. 1. The receiver 318 is utilized to receive RF signals via the antenna 322 during a simulation. In short, the transmitter 316 and receiver 318 are used to communicate with the central controller 110, the vehicles 102-106 and players 112-116 in the simulation.

The communications channel 320 is a mechanism utilized by the central processor 312 to exchange information as an alternative to using the transmitter 316 and receiver 318. The communications channel 320 may be used to send or receive information over a static wired link, such as a USB port, an Ethernet port, an RS232 port or a serial port. In one embodiment of the present invention, the room associator 300 may also include battery pack (not shown) for powering the room associator 300 unit. In another embodiment of the present invention, the room associator 300 may include a wired outlet or plug for coupling with constant power source for powering the room associator 300 unit.

Figure 3C:
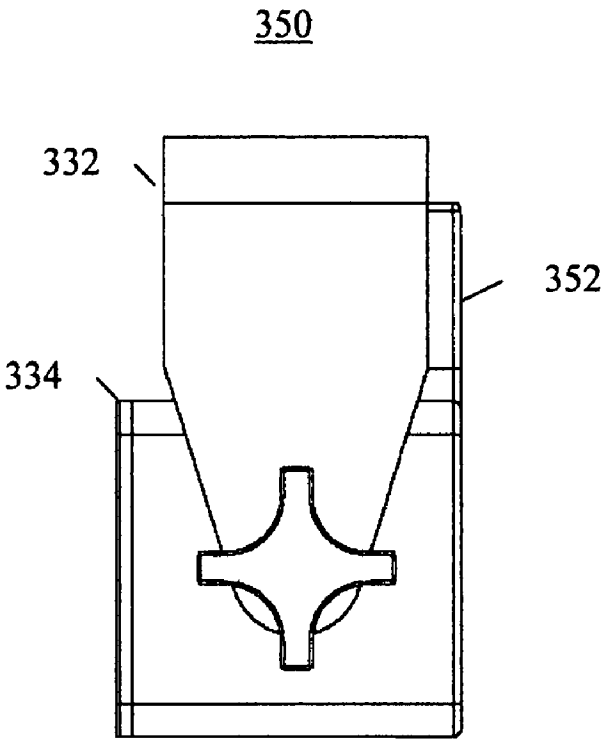
FIG. 3C is an illustration showing a side view of the room associator apparatus 350 of FIG. 3B.
Figure 3B:
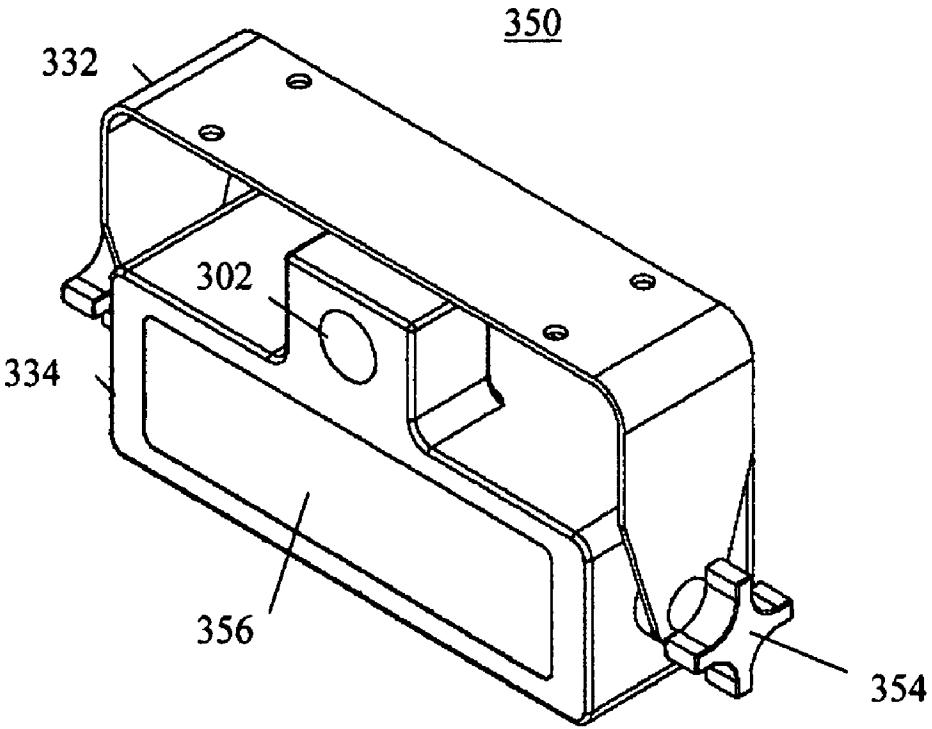
FIG. 3B is an illustration showing a perspective view of the room associator apparatus in one embodiment of the present invention.

FIG. 3B is an illustration showing a perspective view of the room associator apparatus 350 in one embodiment of the present invention. FIG. 3B shows the room associator 350 of the present invention, used for relaying signals and other simulation data within or around edifices during the course of a simulation. The room associator 350 is encased in a housing assembly 334 and an edifice mount 332 that is used to mount the room associator 350 onto an edifice.

The edifice mount 332 includes a bracket that is used to customize the angle of the edifice mount 322 in relation to the housing assembly 334. FIG. 3B further shows a fastening screw 354 that is used to tighten or loosen the bracket of the edifice mount 322 in relation to the housing assembly 334. The edifice mount 332 further includes orifices that may be coupled to a portion of an edifice using a fastener such as a screw, a bolt, a nail or the like.

FIG. 3B further shows a transparent or translucent panel 356, which covers a bay or area within the housing assembly 334 that may include various elements of the room associator 350, such as a transmitter, a receiver, an IR emitter, or other elements. FIG. 3B also shows an element 352 that may house the camera or speaker/microphone of the room associator 350.

FIG. 3C is an illustration showing a side view of the room associator apparatus 350 of FIG. 3B. FIG. 3B shows the room associator 350 encased in a housing assembly 334 and an edifice mount 332 that is used to mount the room associator 350 onto an edifice. Also shown is the element 352 that may house the camera or speaker/microphone of the room associator 350.

Figure 4:
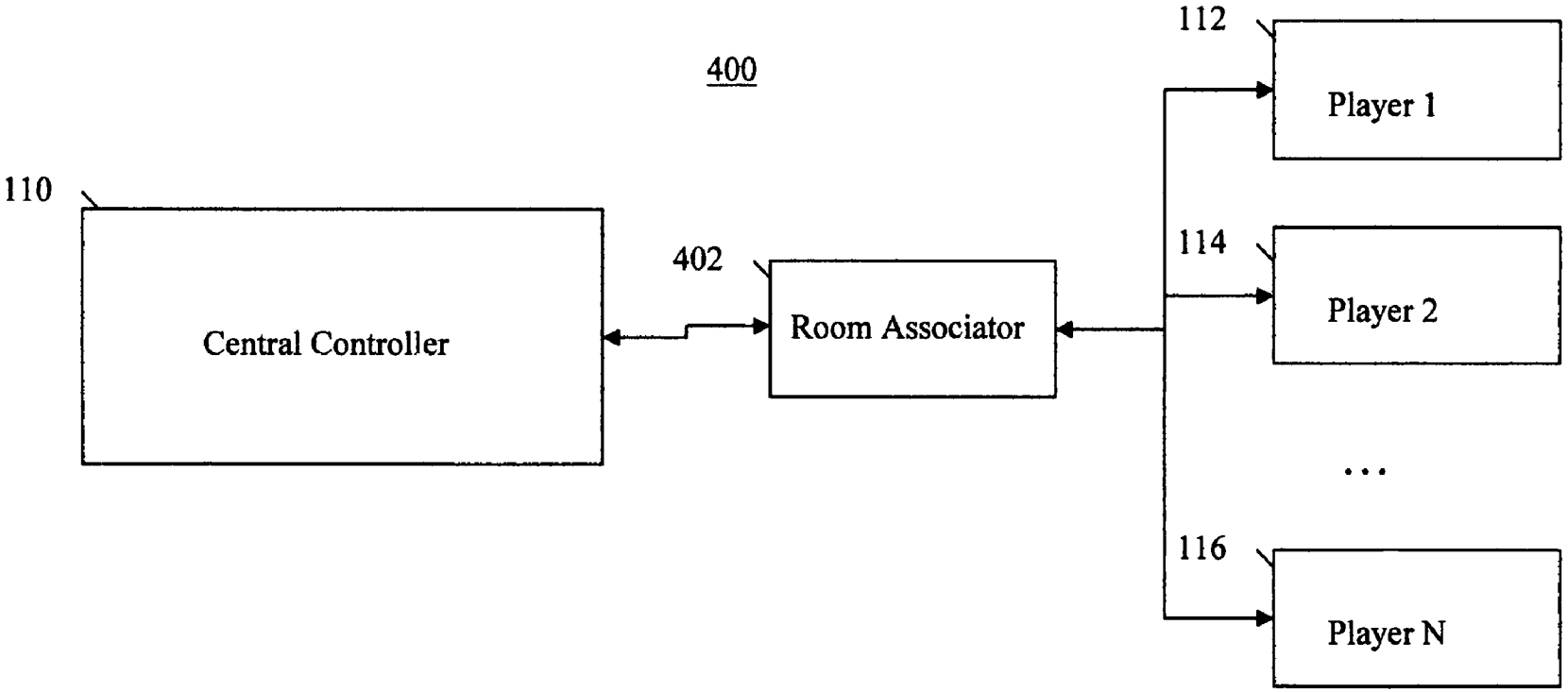
FIG. 4 is a block diagram showing the system architecture of a radio-controlled military simulation system in one embodiment of the present invention.

FIG. 4 is a block diagram showing the system architecture of a radio-controlled military simulation system 400 in one embodiment of the present invention. The radio-controlled military simulation system 400 includes a plurality of individuals 112, 114 through 116 (identical to the individuals of system 100 in FIG. 1), representing soldiers and other individuals participating in the simulation. Each individual 112, 114 and 116 in the military simulation system 400 can interact with each other as well as with the central controller 110, which controls various aspects of the simulation via radio communication and records simulation information.

Note that the radio-controlled military simulation system 400 differs from the conventional radio-controlled military simulation system 100 of FIG. 1 by the inclusion of the room associator 402 between the central controller 110 and the players 112-116. The room associator 402 acts like a relay for simulation data exchanged during the execution of a simulation. Whereas, in a conventional radio-controlled military simulation system 100 players 112-116 and central controller 110 must transmit messages directly between one another, in the radio-controlled military simulation system 400 players 112-116 and central controller 110 transmit messages between one another via a room associator 402. This allows for the exchange of simulation data such as RF messages and commands and IR data between players 112-116 within a building and the central controller 110. Further, the room associator 402 allows for better and more accurate communication among players 112-116 within a room in an edifice. Lastly, the room associator 402 allows for increased communication among between players within and without a room in an edifice.

Figure 5:
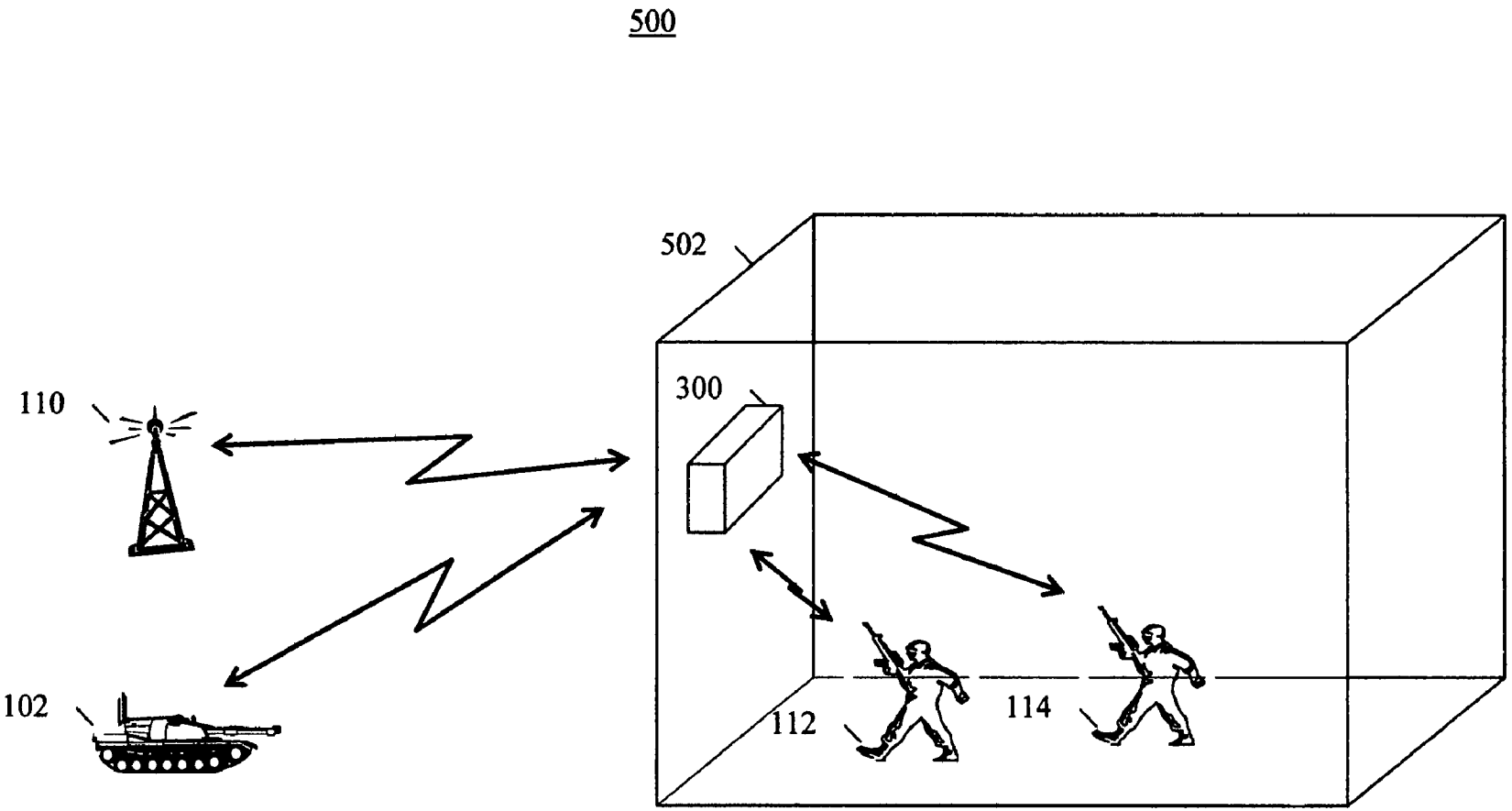
FIG. 5 is an illustration showing an outdoor implementation of the radio-controlled military simulation system of FIG. 4.

FIG. 5 is an illustration showing an outdoor implementation 500 of the radio-controlled military simulation system 400 of FIG. 4. The radio-controlled military simulation system 500 includes individuals 112, 114 (soldiers on foot) within a building 502, and at least one vehicle 102 (a tank). Each individual 112, 114 and vehicle 102 in the military simulation system 500 can interact with each other as well as with the central controller 110, which controls various aspects of the simulation via radio communication.

The radio-controlled military simulation system 500 includes the room associator 300 mounted on the edifice 502 and acting as a relay for simulation data between the central controller 110 and the players 112-114. In the radio-controlled military simulation system 500 players 112-114 and central controller 110 transmit messages between one another via a room associator 300. This allows for the exchange of simulation data such as RF messages and commands and IR data between players 112-114 within a building 502 and the central controller 110. Further, the room associator 300 allows for better and more accurate communication among players 112-114 within the room in the edifice 502. Lastly, the room associator 300 allows for increased communication among between players 112-114 within the building 502 and the vehicle 102.

The room associator 300 may communicate with the central controller 110 via RF signals and communicate with players 112-114 via RF and IR signals. The room associator 300 may send commands to players 112-114, as described more fully below. The central controller 110 may further send commands to the room associator 300 to perform certain tasks, such as transmitting updated player information, transmitting simulation updated event data and taking and transmitting video or still images or sound recordings of simulation events.

The room associator 300 may further log simulation event data such as: 1) RF messages from players indicating status such as alive, dead or injured, 2) IR events from players including the firing of simulated shots within or without a room, 3) still images taken of a simulation event, 4) sound recordings taken of a simulation event. The room associator 300 may further transmit the logged data to the central controller 110 over an RF signal only when the event occurs. Limiting transmission of such data only when events occur and not periodically saves battery power of the mobile simulation units, saves battery power of the room associators 300 and decreases the use of bandwidth during a simulation.

In one embodiment of the present invention, the room associator 300 may be used in the radio-controlled military simulation system 500 to simulate a wall breaching simulation event. In one example, the vehicle 102 may fire a weapon, using an IR device for example, on the building 502. An IR receiver mounted on the outside of the building 502 may receive the IR signal and relay it to the room associator 300, which may then send an IR signal indicating a damage indicator to the players 112-114. In one alternative, the room associator 300 may determine, after receiving the IR signal from the vehicle 102, that half of all players within the room would be killed. In this example, the room associator 300 may then either: 1) scan half the area of the room with its IR emitter or scanner 308 and send a kill message to those players within that half of the room or 2) send a kill message via RF to half of the players within the room. The sequence of events executed by the room associator 300 during the course of a wall breaching event is described in more detail with reference to the flow chart of FIG. 9 below.

In another embodiment of the present invention, the room associator 300 may be used in the radio-controlled military simulation system 500 to send simulation commands such as a reset command. For example, the central controller 110 may send a reset command to the room associator 300, which may then send an IR signal indicating the reset command to the players 112-114. The sequence of events executed by the room associator 300 during the course of a the transmission of a simulation command is described in more detail with reference to the flow chart of FIG. 10 below.

In another embodiment of the present invention, the room associator 300 may be used in the radio-controlled military simulation system 500 to simulate barrier strength of the building 502. In one example, the vehicle 102 may fire a weapon, using an IR device for example, on the building 502. An IR receiver mounted on the outside of the building 502 may receive the IR signal and relay it to the room associator 300, which may then determine the damage that must occur within the building 502 according to the barrier strength of the building 502. Once this determination is made, the room associator 300 may then send an IR signal indicating a damage indicator to the players 112-114. In one alternative, the room associator 300 may determine, after receiving the IR signal from the vehicle 102, that a quarter or all of the players within the room would be killed. In this example, the room associator 300 may then either: 1) scan a quarter or all of the area of the room with its IR emitter or scanner 308 and send a kill message to those players within that portion of the room or 2) send a kill message via RF to a quarter or all of the players within the room. The sequence of events executed by the room associator 300 during the course of a barrier strength determination process is described in more detail with reference to the flow chart of FIG. 10 below.

In another embodiment of the present invention, the room associator 300 may be used in the radio-controlled military simulation system 500 to simulate target fire-back within the building 502. Target fire-back refers to the use of fake or simulated enemies that actually fire back at a player. Typically, dummies or cardboard cut-outs representing an enemy individual are used to present a visual representation of an enemy. In this embodiment, the room associator 300 simulates the firing back of simulated bullets or other ordinance by a simulated enemy. In one example, room associator 300 may determine that a player 112 has entered into a room of the building 502. The room associator 300 may then send an IR signal indicating a damage indicator to the players 112 entering the room by scanning a portion of the area of the room with its IR emitter or scanner 308 and send a kill or injure message to those players within that portion of the room. The sequence of events executed by the room associator 300 during the course of a target fire-back event is described in more detail with reference to the flow chart of FIG. 11 below.

In another embodiment of the present invention, the room associator 300 may be used in the radio-controlled military simulation system 500 to reduce laser ricochets within the building 502. Laser ricochet refers to the ricocheting of IR signals within a room when players shoot simulated weapons within a room such as room 502. It is common for simulated shots using IR signals to ricochet off of walls or floors and hitting a player, thereby decreasing the realism of the simulation. The room associator 300 can reduce the incidence of laser ricochets by sending a command to players within room 502 to reduce the sensitivity of their mobile simulation units. By reducing the sensitivity of a mobile simulation unit, the unit can reduce the probability of receiving a reflected or ricocheted IR signal.

In another embodiment of the present invention, the room associator 300 may be used in the radio-controlled military simulation system 500 to provide automatic backlighting of simulation events. In one example, the room associator 300 may detect one player 112 firing upon another player 114 (by detecting an IR signal) and trigger the taking of video or still images or sound recordings using the embedded camera 306 and/or speaker/microphone 309. Before a video or still image is taken, the room associator 300 may activate the IR transmitter 308 to backlight or illuminate the scene with IR light in order for the camera 306 to adequately capture an image. The sequence of events executed by the room associator 300 during the course of the automatic backlighting of a simulation event is described in more detail with reference to the flow chart of FIG. 8 below.

In another embodiment of the present invention, the room associator 300 may be used in the radio-controlled military simulation system 500 to simulate an area weapon simulation event. In one example, a weapon such as a nuclear device or a chemical agent released over a large area is activated upon the building 502. An IR receiver mounted on the outside of the building 502 may receive the IR signal and relay it to the room associator 300, which may then send an IR signal indicating a damage indicator to the players 112-114. All players within the room are determined to be killed when such an area weapon is activated. In this example, the room associator 300 may then scan the area of the room with its IR emitter or scanner 308 and send a kill message to those players within the room. The sequence of events executed by the room associator 300 during the course of an area weapon simulation event is described in more detail with reference to the flow chart of FIG. 10 below.

Figure 6:
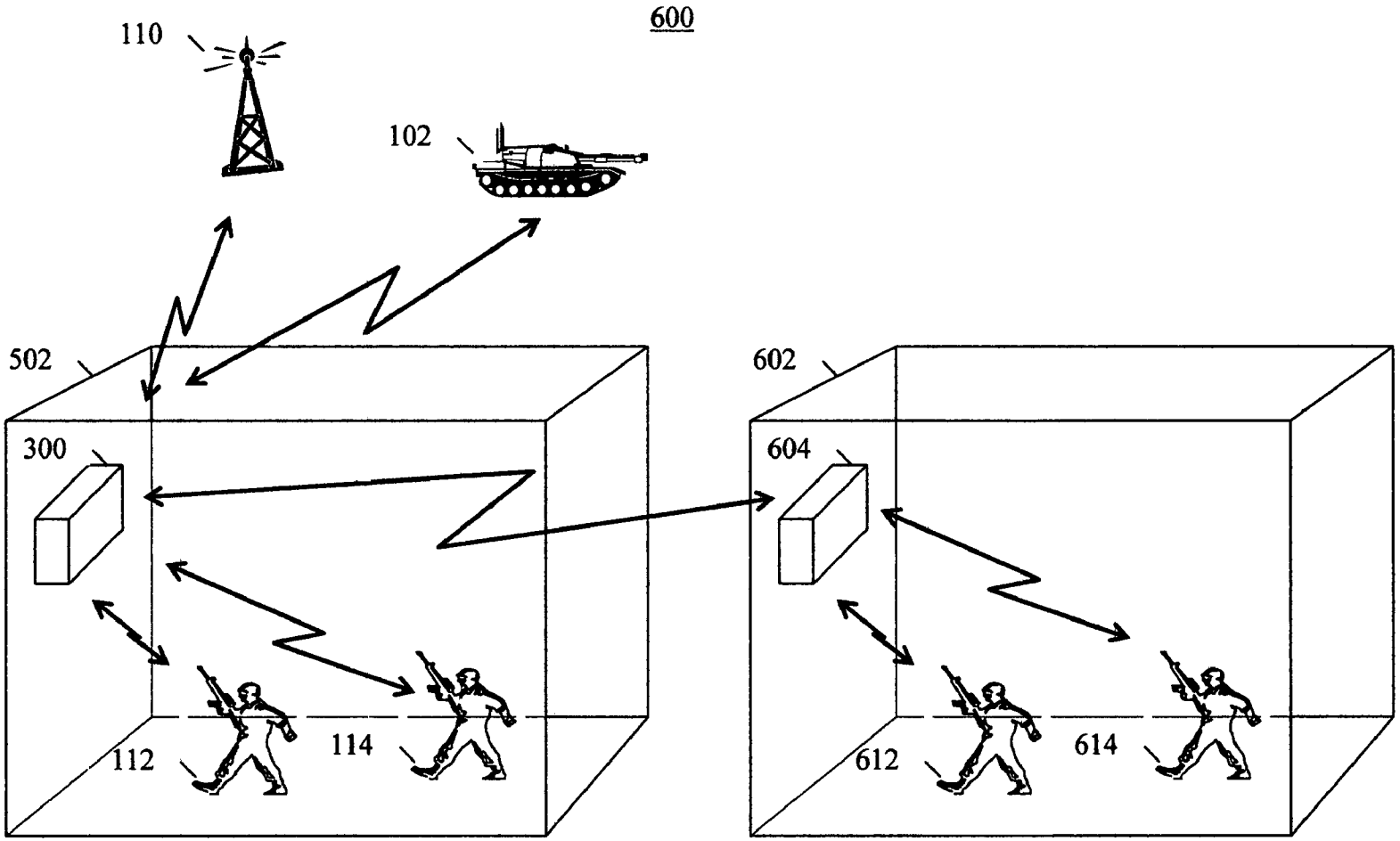
FIG. 6 is an illustration showing an outdoor implementation of a radio-controlled military simulation system according to one embodiment of the present invention.

FIG. 6 is an illustration showing an outdoor implementation of a radio-controlled military simulation system 600 according to one embodiment of the present invention. The radio-controlled military simulation system 600 includes individuals 112, 114 (soldiers on foot) within a building 502, individuals 612, 614 (soldiers on foot) within a building 602, and at least one vehicle 102 (a tank). Each individual and vehicle in the military simulation system 600 can interact with each other as well as with the central controller 110, which controls various aspects of the simulation via radio communication.

The radio-controlled military simulation system 600 includes the room associator 300 mounted on the edifice 502 and the room associator 604 mounted on the edifice 602. In the radio-controlled military simulation system 600 the room associators 300, 604 transmit messages between one another via RF signals. This allows for the exchange of simulation data such as RF messages and commands and IR data between room associators 300, 604 and, by extension, players 112-114 and 612, 614 within different rooms 502, 602 and the central controller 110. The room associators 300, 604 allow for increased communication among between players 112-114 and 612, 614 and the vehicle 102.

In one embodiment of the present invention, the room associators 300, 604 of the radio-controlled military simulation system 600 transmit messages between one another via RF signals to propagate large explosions or area weapons. In one example, the room associator 300 receives an area weapon or large explosion indicator via RF, for example, and scans the area of the room 502 to insure that the players 112, 114 are sent kill signals. Further, the room associator 300 sends the area weapon or large explosion indicator via RF to the room associator 604, which then scans the area of the room 602 to insure that the players 612, 614 are sent kill signals. Using this method, damage may be propagated over a large area by propagation of RF signals via room associators 300, 604.

In another embodiment of the present invention, the room associators 300, 604 of the radio-controlled military simulation system 600 can be used to provide position location for the players within rooms 502, 602. Typically, GPS devices can drop off or lose their signal when they are indoors. The room associators 300, 604, however, can be used to locate players and store and/or transmit their locations. In one example, the room associators 300, 604 store their positions, such as latitude and longitude. When a player such as player 112 enters into the room 502, the room associator 300 sends its position to player 112, which can then send its position to the central controller 110 over an RF signal via a mobile simulation unit. Alternatively, once a player 112 enters into the room 502, the room associator 300 may send the position of player 112 to the central controller 110 over an RF link.

Further, when player 112 enters into the room 602, the room associator 604 sends its position to player 112, which can then send its position to the central controller 110 over an RF signal via a mobile simulation unit. Alternatively, the room associator 604 may send the position of player 112 to the central controller 110 over an RF link.

Figure 7:
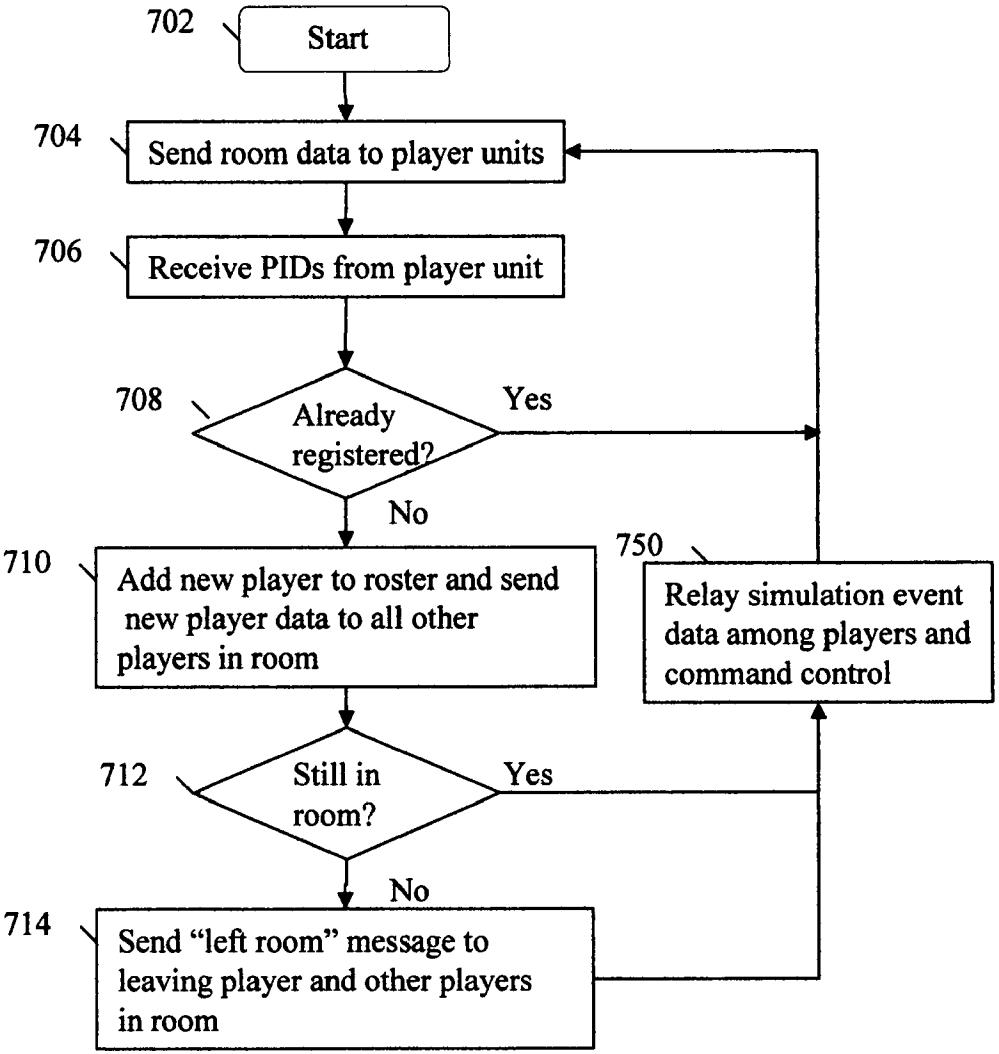
FIG. 7 is a flow chart depicting the control flow of the player identification process that takes place within a room associator when players enter and leave a room, according to one embodiment of the present invention.

FIG. 7 is a flow chart depicting the control flow of the player identification process that takes place within a room associator 300 when players enter and leave a room, according to one embodiment of the present invention. The control flow begins with step 702 and proceeds immediately to step 704. Prior to step 704, a player, such as player 112, enters into the room 502 and his mobile simulation unit stores an indicator that player 112 has entered into the room 502. In step 704, the room associator 300 detects player 112 entering into the room 502. The room associator 300 sends its identifying data via RF or IR signal to the player 112, which responds by sending an RF signal to the room associator 300. In step 706, the room associator 300 receives from the player 112 an RF signal including, for example, the PID or personal identification of the player 112.

In step 708, it is determined whether the player 112 has previously been registered or logged as a player in the roster of the room associator 300. A roster is a list or other memory segment stored, for example, in data storage 310 or memory 314. The roster includes those players that are currently located in the room 502. If the determination of step 708 is positive, the player is already on the roster and control flows back to step 704. If the determination of step 708 is negative, the player is not on the roster and control flows to step 710.

In step 710, the player 112 and his PID are added to the roster and the PID of player 112 is transmitted to the other players in the room 502 via RF signal. In step 712, it is determined whether the player 112 is still located in room 502. If the determination of step 712 is positive, the player 112 is ready for game play and control flows to step 750. If the determination of step 712 is negative, the player 112 has left the room 502 and control flows to step 714. In step 714, the room associator 300 sends via RF a "left room" message to the player 121 and a similar message to the other players in room 502 indicating that player 112 has left the room 502. Player 112 stores an indicator indicating that he left the room 502 and subsequently ignores all other messages emanating from the room 502 and room associator 300. Subsequently, control flows to step 750.

In step 750, the room associator 300 relays simulation event data among players on the roster for room 502. This encompasses a variety of functions described in more detail with reference to FIGS. 8-11 below.

Figure 8:
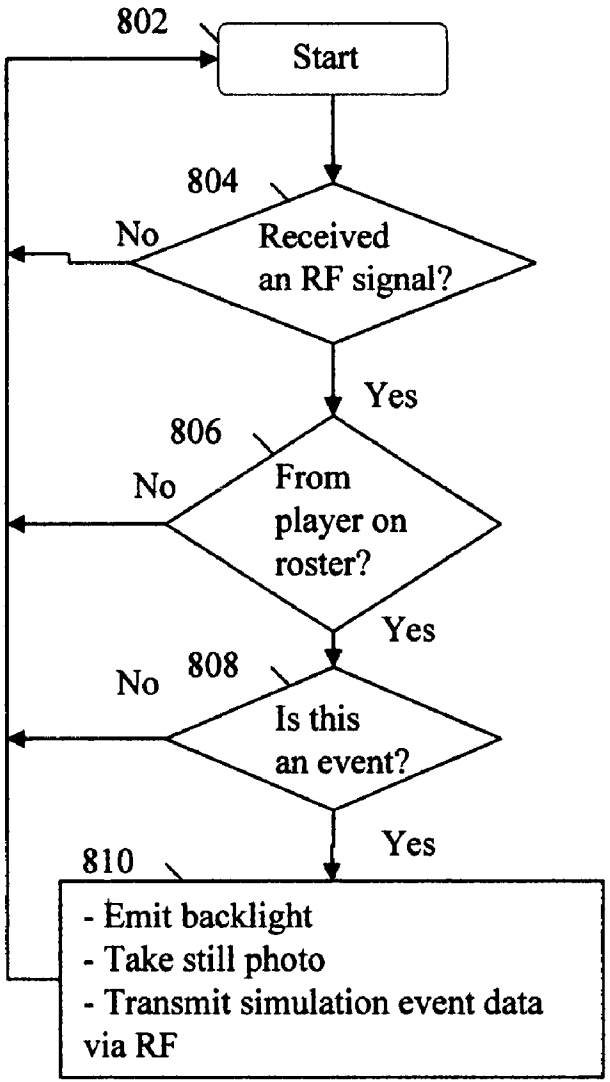
FIG. 8 is a flow chart depicting the control flow of the simulation event logging process that takes place within a room associator when a simulation event is logged, according to one embodiment of the present invention.

FIG. 8 is a flow chart depicting the control flow of the simulation event logging process that takes place within a room associator 300 when a simulation event is logged, according to one embodiment of the present invention. The process of the flow chart of FIG. 8 is carried out during the execution of step 750 of FIG. 7. The control flow begins with step 802 and proceeds immediately to step 804. In step 804, it is determined whether the room associator 300 has received an RF signal. If so, control flows to step 806. Otherwise, control flows back to step 802. In step 806, it is determined whether the received RF signal came from a player on the roster. If so, control flows to step 808. Otherwise, control flows back to step 802. In step 808, it is determined whether the received RF signal from a player on the roster consists of a simulation event worth recording, for example an engagement resulting in a kill of a player. If so, control flows to step 810. Otherwise, control flows back to step 802.

In step 810, the room associator 300 takes video or still images or sound recordings of the simulation event using the embedded camera 306 and/or speaker/microphone 309. Before a video or still image is taken, the room associator 300 may activate the IR transmitter 308 to backlight or illuminate the scene with IR light in order for the camera 306 to adequately capture an image. Subsequently, the video or still images or sound recordings of the simulation event taken by the room associator 300 is transmitted to the central controller 110 via RF link.

Figure 9:
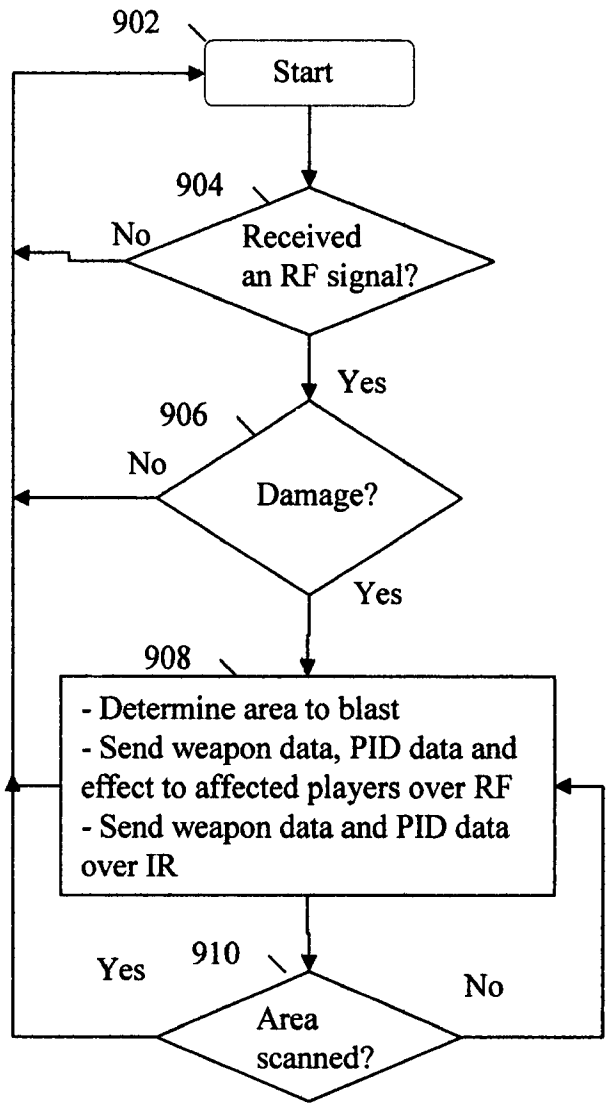
FIG. 9 is a flow chart depicting the control flow of the wall breaching process that takes place within a room associator when a wall breach occurs, according to one embodiment of the present invention.

FIG. 9 is a flow chart depicting the control flow of the wall breaching process that takes place within a room associator 300 when a wall breach occurs, according to one embodiment of the present invention. The process of the flow chart of FIG. 9 is carried out during the execution of step 750 of FIG. 7. The control flow begins with step 902 and proceeds immediately to step 904. In step 904, it is determined whether the room associator 300 has received an RF signal. If so, control flows to step 906. Otherwise, control flows back to step 902. In step 906, it is determined whether the received RF signal consists of a simulation event that would cause damage to items or players within the room 502, for example a blast from an external tank resulting in a kill of a player. If so, control flows to step 908. Otherwise, control flows back to step 902.

In step 908, determines the area of room 502 to which damage should be directed, i.e., the area of the room 502 to which the blast should be applied. The room associator 300 then sends an RF signal to all affected players in the blast area, wherein the RF signal may include such information as a weapon identifier, the PID of the affected players and the effect of the blast. Alternatively, the room associator 300 may send an IR signal to all affected players in the blast area, wherein the IR signal may include such information as a weapon identifier and the PID of the affected players.

In step 910, it is determined whether the room associator 300 has completed scanning the affected areas of the room 502 and thus causing damage to items or players within the blast area of room 502. If so, control flows back to step 902. Otherwise, control flows back to step 908 until the predetermined area has been completely scanned.

Figure 10:
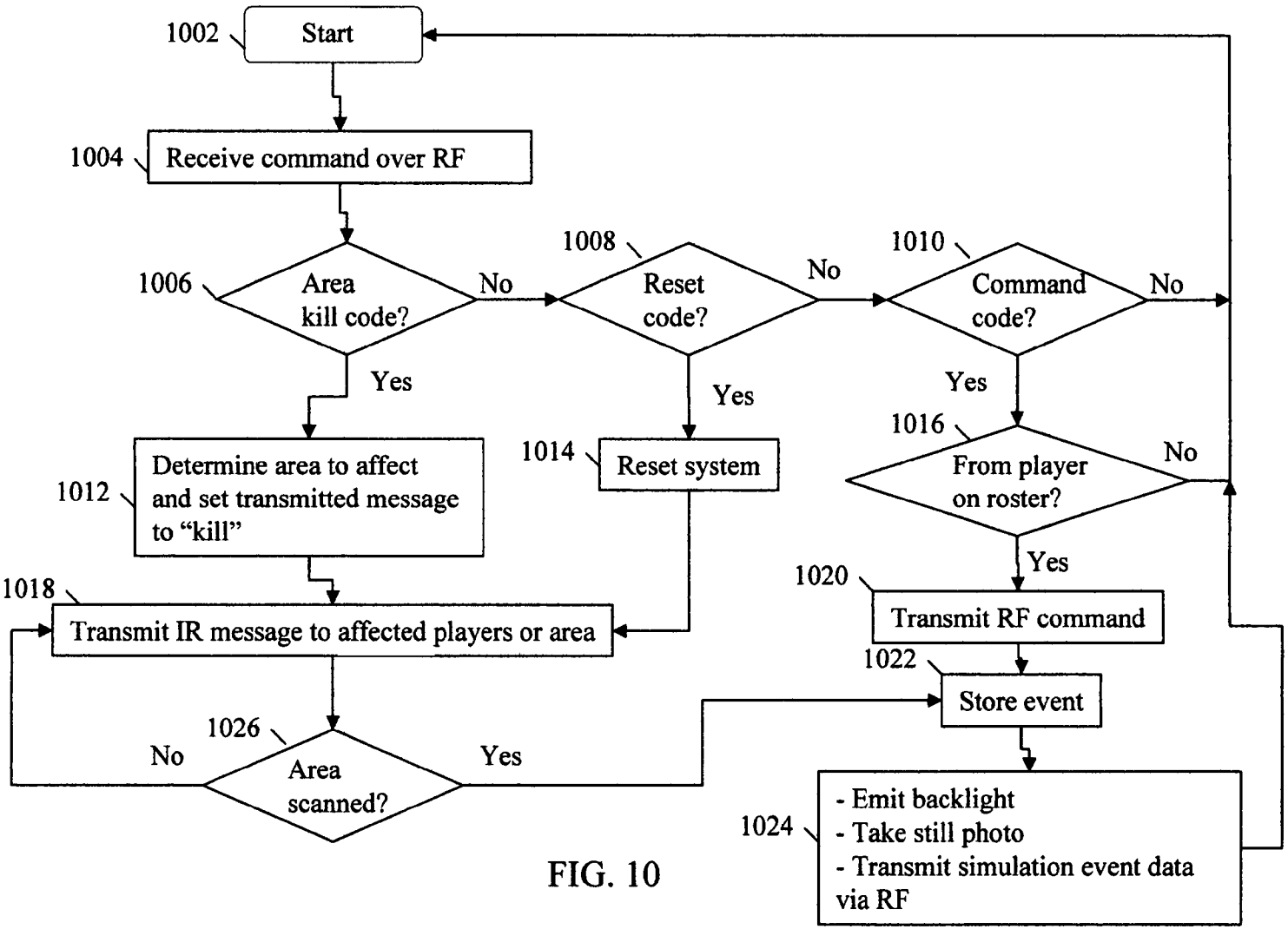
FIG. 10 is a flow chart depicting the control flow of the area indicator process that takes place within a room associator when a simulation command or an area weapon are executed, according to one embodiment of the present invention.

FIG. 10 is a flow chart depicting the control flow of the area indicator process that takes place within a room associator 300 when a simulation command or an area weapon are executed, according to one embodiment of the present invention. The process of the flow chart of FIG. 10 is carried out during the execution of step 750 of FIG. 7. The control flow begins with step 1002 and proceeds immediately to step 1004.

In step 1004, the room associator 300 has received a command, whether a simulation command or an area weapon indicator, over RF.

In step 1006 it is determined whether the received command is an area kill code, such as from an area weapon. If so, control flows to step 1012. Otherwise, the control flows to step 1008. In step 1008 it is determined whether the received command is a reset code, which is a simulation command. If so, control flows to step 1014. Otherwise, the control flows to step 1010. In step 1010 it is determined whether the received command is a command code, such as from another player. If so, control flows to step 1016. Otherwise, the control flows back to step 1002.

In step 1012, the room associator 300 determines the area within the room 502 to affect with the area weapon. In step 1018, the room associator 300 transmits over IR the proper kill or injury code to the affected players within the room 502. In step 1026, it is determined whether the room associator 300 has completed scanning the affected areas of the room 502 and thus causing damage to items or players within the blast area of room 502. If so, control flows to step 1022. Otherwise, control flows back to step 1018 until the predetermined area has been completely scanned. In step 1014, the room associator 300 and subsequently in step 1018, the room associator 300 transmits over IR the reset code to the players within the room 502.

In step 1016, it is determined whether the received command originated from a player on the roster of the room 502. If so, control flows to step 1020. Otherwise, the control flows back to step 1002. In step 1020, the room associator 300 transmits over RF the command to the intended recipient player in the room 502. In step 1022, the room associator 300 stores the event and subsequently in step 1024, the room associator 300 takes video or still images or sound recordings of the simulation event using the embedded camera 306 and/or speaker/microphone 309. Before a video or still image is taken, the room associator 300 may activate the IR transmitter 308 to backlight or illuminate the scene with IR light in order for the camera 306 to adequately capture an image. Then, the video or still images or sound recordings of the simulation event taken by the room associator 300 is transmitted to the central controller 110 via RF link. Subsequently, control flows back to step 1002.

Figure 11:
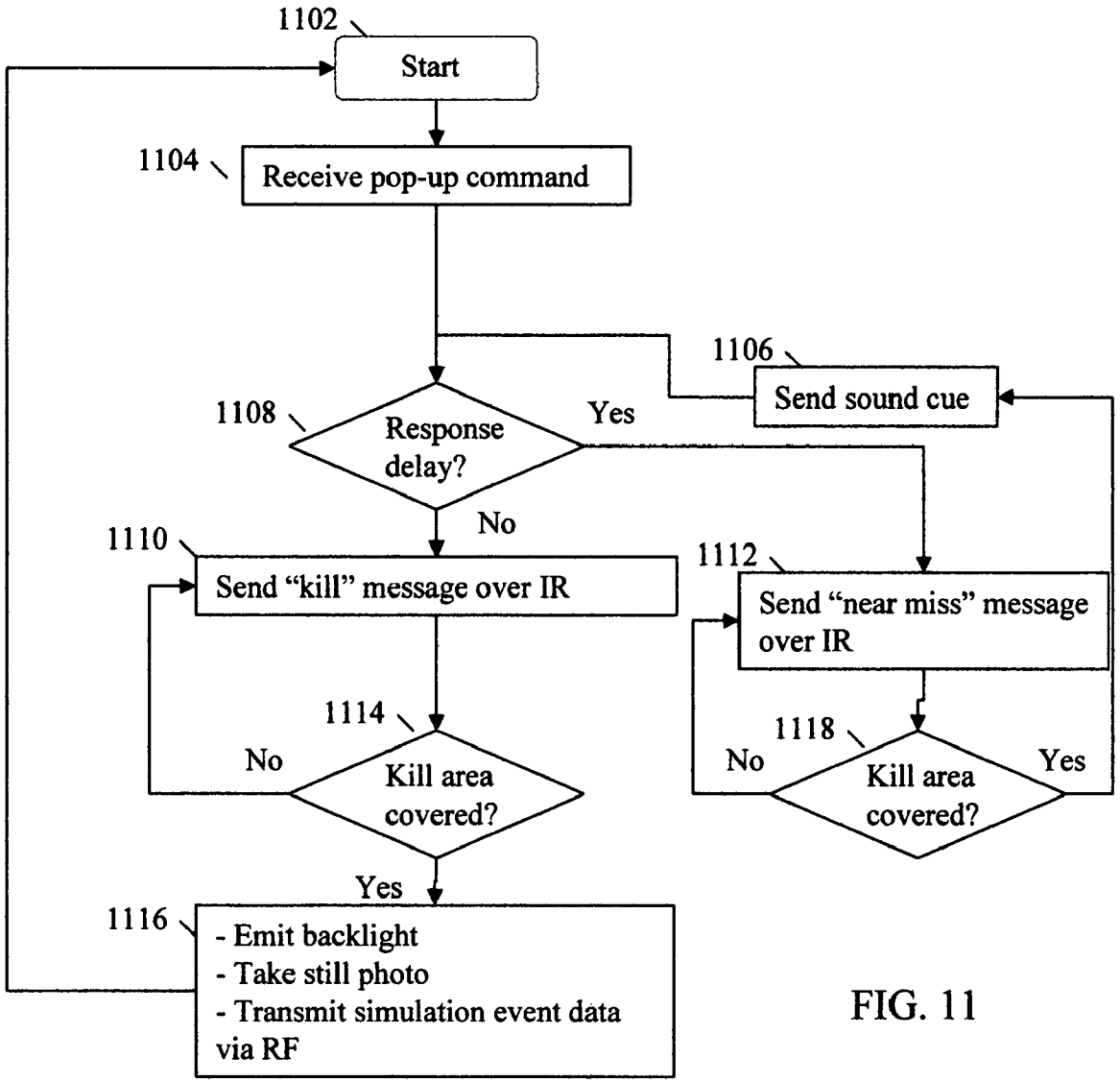
FIG. 11 is a flow chart depicting the control flow of the target fire-back process that takes place within a room associator when a simulated target fires back, according to one embodiment of the present invention.

FIG. 11 is a flow chart depicting the control flow of the target fire-back process that takes place within a room associator 300 when a simulated target fires back, according to one embodiment of the present invention. The process of the flow chart of FIG. 11 is carried out during the execution of step 750 of FIG. 7. The control flow begins with step 1102 and proceeds immediately to step 1104. In step 1104, the room associator 300 receives a pop-up command over RF that initiates the target fire-back process. In step 1108, it is determined whether a response delay is activated. A response delay is a window during which non-fatal messages, such as near miss messages, are transmitted to players within the room 502 so as to give them time to react. If response delay is activated, control flows to step 1112. Otherwise, the control flows back to step 1110.

In step 1112, the room associator 300 sends near miss messages to the players within the affected area of the room 502. In step 1118, it is determined whether the room associator 300 has completed scanning the affected areas of the room 502. If so, control flows to step 1106. Otherwise, control flows back to step 1112 until the predetermined area has been completely scanned. In step 1106, the room associator emits a sound cue such as a simulated shot or a simulated blast.

In step 1110, the room associator sends a kill message to the players within the affected area of the room 502. In step 1114, it is determined whether the room associator 300 has completed scanning the affected areas of the room 502. If so, control flows to step 1116. Otherwise, control flows back to step 1110 until the predetermined area has been completely scanned. In step 1116, the room associator 300 takes video or still images or sound recordings of the simulation event using the embedded camera 306 and/or speaker/microphone 309. Before a video or still image is taken, the room associator 300 may activate the IR transmitter 308 to backlight or illuminate the scene with IR light in order for the camera 306 to adequately capture an image. Subsequently, control flows back to step 1102.

The present invention can be realized in hardware, software, or a combination of hardware and software. A system 400 and apparatus 300 according to a preferred embodiment of the present invention can be realized in a centralized fashion in one processor, or in a distributed fashion where different elements are spread across several processors. Any kind of information processing system—or other apparatus adapted for carrying out the methods described herein—is suited. A typical combination of hardware and software could be a general-purpose computer system with a computer program that, when being loaded and executed, controls the computer system such that it carries out the methods described herein.

An embodiment of the present invention can also be embedded in a computer program product, which comprises all the features enabling the implementation of the methods described herein, and which, when loaded in a computer system, is able to carry out these methods. Computer program means or computer program in the present context mean any expression, in any language, code or notation, of a set of instructions intended to cause a system having an information processing capability to perform a particular function either directly or after either or both of the following: a) conversion to another language, code or, notation; and b) reproduction in a different material form.

A computer system may include, inter alia, one or more computers and at least a computer readable medium, allowing a computer system, to read data, instructions, messages or message packets, and other computer readable information from the computer readable medium. The computer readable medium may include non-volatile memory, such as ROM, Flash memory, Disk drive memory, CD-ROM, and other permanent storage. Additionally, a computer readable medium may include, for example, volatile storage such as RAM, buffers, cache memory, and network circuits. Furthermore, the computer readable medium may comprise computer readable information in a transitory state medium such as a network link and/or a network interface, including a wired network or a wireless network, which allow a computer system to read such computer readable information.

Figure 12:
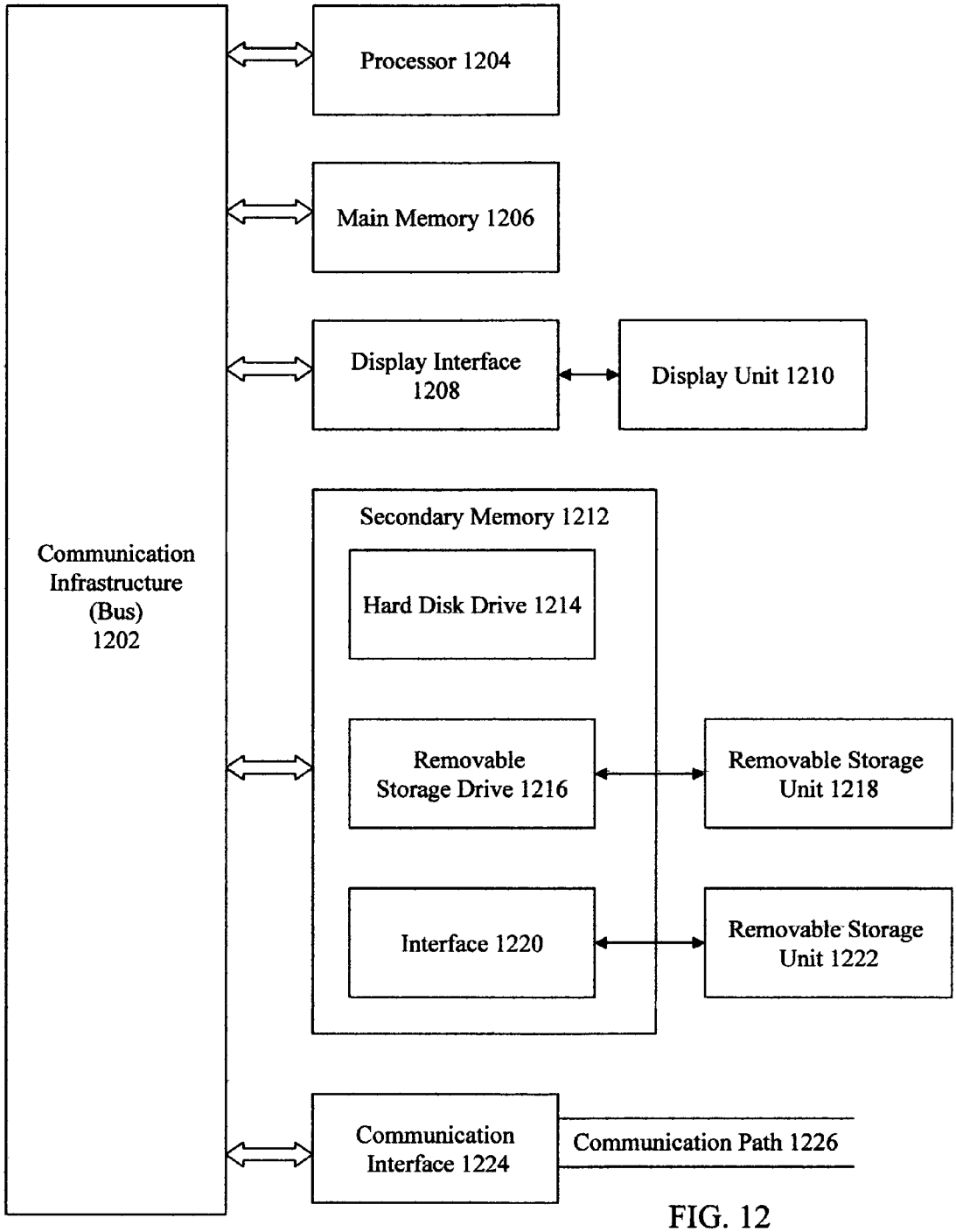
FIG. 12 is a high level block diagram showing an information processing system useful for implementing one embodiment of the present invention.

FIG. 12 is a high level block diagram showing an information processing system useful for implementing one embodiment of the present invention. The computer system includes one or more processors, such as processor 1204. The processor 1204 is connected to a communication infrastructure 1202 (e.g., a communications bus, cross-over bar, or network). Various software embodiments are described in terms of this exemplary computer system. After reading this description, it will become apparent to a person of ordinary skill in the relevant art(s) how to implement the invention using other computer systems and/or computer architectures.

The computer system can include a display interface 1208 that forwards graphics, text, and other data from the communication infrastructure 1202 (or from a frame buffer not shown) for display on the display unit 1210. The computer system also includes a main memory 1206, preferably random access memory (RAM), and may also include a secondary memory 1212. The secondary memory 1212 may include, for example, a hard disk drive 1214 and/or a removable storage drive 1216, representing a floppy disk drive, a magnetic tape drive, an optical disk drive, etc. The removable storage drive 1216 reads from and/or writes to a removable storage unit 1218 in a manner well known to those having ordinary skill in the art. Removable storage unit 1218, represents a floppy disk, a compact disc, magnetic tape, optical disk, etc. which is read by and written to by removable storage drive 1216. As will be appreciated, the removable storage unit 1218 includes a computer readable medium having stored therein computer software and/or data.

In alternative embodiments, the secondary memory 1212 may include other similar means for allowing computer programs or other instructions to be loaded into the computer system. Such means may include, for example, a removable storage unit 1222 and an interface 1220. Examples of such may include a program cartridge and cartridge interface (such as that found in video game devices), a removable memory chip (such as an EPROM, or PROM) and associated socket, and other removable storage units 1222 and interfaces 1220 which allow software and data to be transferred from the removable storage unit 1222 to the computer system.

The computer system may also include a communications interface 1224. Communications interface 1224 allows software and data to be transferred between the computer system and external devices. Examples of communications interface 1224 may include a modem, a network interface (such as an Ethernet card), a communications port, a PCMCIA slot and card, etc. Software and data transferred via communications interface 1224 are in the form of signals which may be, for example, electronic, electromagnetic, optical, or other signals capable of being received by communications interface 1224. These signals are provided to communications interface 1224 via a communications path (i.e., channel) 1226. This channel 1226 carries signals and may be implemented using wire or cable, fiber optics, a phone line, a cellular phone link, an RF link, and/or other communications channels.

In this document, the terms "computer program medium," "computer usable medium," and "computer readable medium" are used to generally refer to media such as main memory 1206 and secondary memory 1212, removable storage drive 1216, a hard disk installed in hard disk drive 1214, and signals. These computer program products are means for providing software to the computer system. The computer readable medium allows the computer system to read data, instructions, messages or message packets, and other computer readable information from the computer readable medium. The computer readable medium, for example, may include non-volatile memory, such as a floppy disk, ROM, flash memory, disk drive memory, a CD-ROM, and other permanent storage. It is useful, for example, for transporting information, such as data and computer instructions, between computer systems. Furthermore, the computer readable medium may comprise computer readable information in a transitory state medium such as a network link and/or a network interface, including a wired network or a wireless network, which allow a computer to read such computer readable information.

Computer programs (also called computer control logic) are stored in main memory 1206 and/or secondary memory 1212. Computer programs may also be received via communications interface 1224. Such computer programs, when executed, enable the computer system to perform the features of the present invention as discussed herein. In particular, the computer programs, when executed, enable the processor 1204 to perform the features of the computer system. Accordingly, such computer programs represent controllers of the computer system.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

We claim:

1. A computer apparatus for communicating simulation data, comprising:

an assembly for mounting the computer apparatus in a stationary position in a room;

an infrared (IR) transmitter for sending identifying data identifying the room to at least first mobile simulation unit of a plurality of mobile simulation units;

a receiver for receiving simulation data over radio frequency from the plurality of mobile simulation units, each of the plurality of mobile simulation units being within a range of the stationary position in the room and for receiving simulation data from a central controller in a remote location from the room;

a transmitter for transmitting simulation data over radio frequency to the plurality of mobile simulation units and to the central controller; and a tangible memory configured to maintain in real time records for all of a plurality of players in the room, each of the plurality of players carrying a corresponding one of the mobile simulation units, said records indicating whether each of the plurality of players is located in the room or not, wherein said computer apparatus is operable to receive a radio frequency signal from at least the first mobile simulation unit that identifies a corresponding player in response to sending the identifying data, upon receipt of the radio frequency signal the records of the tangible memory being updated in real time to indicate that the corresponding player is in the room.

2. The computer apparatus of claim 1, each mobile simulation unit being operable to detect a simulation event that causes a status of a player carrying the mobile simulation unit to change, wherein each mobile simulation unit is operable to transmit the simulation data to the computer apparatus responsive to the detected simulation event, wherein the computer apparatus is operable to retransmit the simulation data of the simulation event received from one of the mobile simulation units in the range to the central controller, wherein the computer apparatus only transmits the simulation data from the plurality of mobile simulation units in the range to the central controller when the simulation data indicates that the status of the player carrying the mobile simulation unit has changed, wherein outside the range, each mobile simulation unit communicates directly with the central controller, and wherein inside the range, each mobile simulation unit does not communicate directly with the central controller but always uses the computer apparatus as a communication intermediary.

3. The computer apparatus of claim 1, wherein the computer apparatus is a Multiple Integrated Laser Engagement System (MILES) compliant apparatus, wherein each of the mobile simulation units is a MILES compliant mobile simulation unit, wherein said computer apparatus functions as a communication intermediary between the central controller and the mobile simulation units present in the range.

4. The computer apparatus of claim 1, wherein the receiver receives the simulation data from the plurality of mobile simulation units over radio frequency and over infrared frequency, wherein the transmitter transmits the simulation data to the plurality of mobile simulation units over radio frequency and over infrared frequency.

5. The computer apparatus of claim 1, wherein said computer apparatus and said plurality of mobile simulation units are located inside the room, wherein said receiver is operable to receive Multiple Integrated Laser Engagement System (MILES) simulated ordinance firing transmissions unable to penetrate walls of said room originating from a device outside said room, wherein said transmitter is operable to retransmit the MILES simulated ordinance firing transmissions inside said room to said plurality of mobile simulation units.

6. The computer apparatus of claim 1, further comprising a camera for taking a video or a still image, wherein said computer apparatus is operable to take the video or the still image of the room using said camera responsive to an occurrence of a simulation event, said simulation event being an event that causes a status of at least one player carrying one of the plurality of mobile simulation units to change.

7. The computer apparatus of claim 6, wherein the camera is an infrared camera, and wherein said transmitter of said computer apparatus comprises an infrared emitter for providing back light when the camera takes the video or the still image and alternately to send infrared signals over an infrared frequency to the plurality of mobile simulation units.

8. The computer apparatus of claim 1, wherein the computer apparatus is operable to enable a simulation of pop-up targets in the room firing at the players in the range.

9. The computer apparatus of claim 1, wherein the computer apparatus is operable to simulate wall-breaching events for simulated ordinances external to the room.

10. A simulation system, comprising:

a central controller for storing simulation data, the central controller including a transmitter and a receiver; and at least one computer apparatus for communicating simulation data, the at least one computer apparatus mounted in a stationary position in a room comprising:

an infrared (IR) transmitter for sending identifying data identifying the room to at least first mobile simulation unit of a plurality of mobile simulation units;

a receiver for receiving simulation data over radio frequency from the plurality of mobile simulation units, each of the plurality of mobile simulation units being within a range of the stationary position in the room, and for receiving simulation data from the central controller positioned in a remote location from the room;

a transmitter for transmitting simulation data over radio frequency to the plurality of mobile simulation units and to the central controller;

a tangible memory configured to maintain records for all of a plurality of players in the room, each of the plurality of players carrying a corresponding one of the mobile simulation units, said records indicating whether each of the plurality of players is located in the room or not, wherein said computer apparatus is operable to receive a radio frequency signal from at least the first mobile simulation unit that identifies a corresponding player in response to sending the identifying data, upon receipt of the radio frequency signal the records of the tangible memory being updated in real time to indicate that the corresponding player is in the room.

11. The simulation system of claim 10, wherein outside the range, each mobile simulation unit communicates directly with the central controller, and wherein inside the range, each mobile simulation unit does not communicate directly with the central controller but always uses the at least one computer apparatus as a communication intermediary.

12. The simulation system of claim 10, each mobile simulation unit being operable to detect a simulation event that causes a status of a player carrying the mobile simulation unit to change, wherein each mobile simulation unit is operable to transmit the simulation data to the at least one computer apparatus responsive to the detected simulation event, wherein the at least one computer apparatus is operable to retransmit the simulation data of the simulation event received from one of the mobile simulation units in the range to the central controller, wherein the at least one computer apparatus only transmits the simulation data from the mobile simulation units in the range to the central controller when the simulation data indicates that the status of the player carrying the mobile simulation unit has changed.

13. The simulation system of claim 10, wherein the receiver of the at least one computer apparatus receives the simulation data from the plurality of mobile simulation units over radio frequency and over infrared frequency, wherein the transmitter of the at least one computer apparatus transmits the simulation data to the plurality of mobile simulation units over radio frequency and over infrared frequency.

14. The simulation system of claim 10, further comprising a camera for taking a video or a still image, wherein said at least one computer apparatus is operable to take the video or the still image of the room using said camera responsive to an occurrence of a simulation event, said simulation event being an event that causes a status of at least one player carrying one of the plurality of mobile simulation units to change.

15. The simulation system of claim 10, wherein the simulation system comprises a plurality of computer apparatuses, wherein the receiver of each computer apparatus is further configured to receive communications over the radio frequency from another computer apparatus in another room or location associated with an edifice; and wherein the transmitter of each computer apparatus is further configured to transmit communications over the radio frequency to the another computer apparatus in the another room or the location associated with the edifice.

16. A method on a computer for conducting a simulation, comprising:

sending, via an infrared (IR) transmitter, identifying data identifying a room to at least a first mobile simulation unit of a plurality of mobile simulation units;

receiving simulation data by a computer apparatus mounted in a stationary position in the room over radio frequency from at least one of the plurality of mobile simulation units, each carried by a player and each being within a specified range of the stationary position of the room;

transmitting the simulation data from the computer apparatus to the central controller and to a plurality of players over the radio frequency, wherein outside the specified range, each mobile simulation unit communicates directly with a central controller, and wherein inside the specified range, each mobile simulation unit does not communicate directly with the central controller but always uses the computer apparatus as a communication intermediary;

maintaining in a tangible memory of the computer apparatus records for all of a plurality of players in the room, said records indicating whether each player of the plurality of players is located in the room or outside of the room, the computer apparatus being operable to receive a radio frequency signal from at least the first mobile simulation unit that identifies a corresponding player in response to sending the identifying data, upon receipt of the radio frequency signal the records of the tangible memory being updated in real time to indicate that the corresponding player is in the room.

17. The method of claim 16, further comprising:

one of said players firing a simulated weapon at another of said players, which is a target player, wherein the target player is separated from the firing player by a wall of the room;

detecting, by the computer apparatus, the firing by the firing player by a sensor mounted on one side of the wall; and responsive to the detecting, generating, by the computer apparatus, a transmission, wherein said transmission is receivable by a mobile simulation unit of the target player, and wherein the transmission indicates that the firing player has fired the simulated weapon, whereby a simulated ordinance fired by the firing player represents a simulated wall breaching event to affect said target player.

18. The method of claim 16, wherein each mobile simulation unit is a Multiple Integrated Laser Engagement System (MILES) compliant mobile simulation unit, wherein the computer apparatus is geospatially stationary, is mounted to an edifice, and is associated with a fixed geographic region, wherein when each mobile simulation unit is positioned within the fixed geographic region said computer apparatus functions as the communication intermediary between said mobile simulation unit and the central controller, wherein when each mobile simulation unit is positioned outside the fixed geographic region said mobile simulation unit communicates directly with the central controller and the computer apparatus does not function as the communication intermediary between said mobile simulation unit and said central controller, wherein said central controller is located outside the fixed geographic region.

19. The method of claim 16, further comprising:

determining from the received simulation data that a status of a player carrying the mobile simulation unit has changed;

responsive to the determining, the computer apparatus triggering a camera to take a video or a still image of the room; and transmitting the video or the still image from the computer apparatus to the central controller.

20. The method of claim 16, further comprising:

detecting, by the computer apparatus, a firing event of a simulated weapon discharge directed from a shooting entity to a potential target, wherein the shooting entity is not in line of sight of the potential target, and wherein the potential target is carrying one of the mobile simulation units; and transmitting, by the computer apparatus, an infrared signal for the firing event to the potential target, said potential target being within line of sight of the computer apparatus, wherein a mobile simulation unit carried by the potential target selectively reacts to the firing event responsive to receipt of the infrared signal transmitted by the computer apparatus.

21. A computer apparatus for communicating simulation data, comprising:

an assembly for mounting the computer apparatus in a stationary position of a room;

an infrared (IR) transmitter for sending identifying data identifying the room to at least first mobile simulation unit of a plurality of mobile simulation units;

a receiver for receiving simulation data over radio frequency from the plurality of mobile simulation units, each carried by a player and each being within a specified range of the stationary position of the room and for receiving simulation data from a central controller in a remote location from the room;

a transmitter for transmitting simulation data over radio frequency to the plurality of mobile simulation units and to the central controller; and a tangible memory configured to maintain records for all players in the room, said players each carrying one of the mobile simulation units, said records indicating whether each of the players is located in the room or not, wherein said computer apparatus is operable to receive a radio frequency signal from at least the first mobile simulation unit that identifies a corresponding player in response to sending the identifying data, upon receipt of the radio frequency signal the records of the tangible memory being updated in real time to indicate that the corresponding player is in the room.

22. The computer apparatus of claim 21, wherein upon detecting when a player enters or leaves the room, the computer apparatus is operable to send a message to the player and to each of the players in the room containing data identifying the player and whether the player has entered or left the room.

* * * * *